US010684057B2

(12) United States Patent
Kim et al.

(10) Patent No.: US 10,684,057 B2
(45) Date of Patent: Jun. 16, 2020

(54) BLOWER AND REFRIGERATOR HAVING THE SAME

(71) Applicant: Samsung Electronics Co., Ltd., Suwon-si (KR)

(72) Inventors: Hyun Joo Kim, Suwon-si (KR); Young Chul Ko, Suwon-si (KR); Hyo Suck Kang, Suwon-si (KR); Eung Ryeol Seo, Suwon-si (KR); Jung Soo Lim, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 88 days.

(21) Appl. No.: 15/712,623

(22) Filed: Sep. 22, 2017

(65) Prior Publication Data

US 2018/0087820 A1 Mar. 29, 2018

(30) Foreign Application Priority Data

Sep. 23, 2016 (KR) ..... 10-2016-0121968

(51) Int. Cl.
*F25D 17/04* (2006.01)
*F25D 21/04* (2006.01)
(Continued)

(52) U.S. Cl.
CPC ..... *F25D 17/045* (2013.01); *F04D 19/002* (2013.01); *F04D 29/164* (2013.01);
(Continued)

(58) Field of Classification Search
CPC ..... F25D 17/045; F25D 17/065; F25D 17/08; F25D 21/04; F04D 19/002; F04D 29/164; F04D 29/601
See application file for complete search history.

(56) References Cited

U.S. PATENT DOCUMENTS

2005/0091993 A1 5/2005 Paradis
2013/0280523 A1 10/2013 Schwarz et al.

FOREIGN PATENT DOCUMENTS

JP 56-7967 1/1981
JP 7-27468 1/1995
(Continued)

OTHER PUBLICATIONS

Extended European Search Report dated Feb. 26, 2018 in European Patent Application No. 17192759.3.
(Continued)

*Primary Examiner* — Henry T Crenshaw
(74) *Attorney, Agent, or Firm* — Staas & Halsey LLP

(57) ABSTRACT

A blower having improved efficiency by minimizing a distance between an end of a blade and a cold air suction hole, and a refrigerator including the blower includes a body having a storage compartment including a refrigerator compartment and a freezer compartment, an evaporator provided behind the storage compartment and configured to generate cold air, and the blower configured to supply the cold air generated by the evaporator into the freezer compartment, wherein the blower includes a suction member having a cold air suction hole and a fan unit configured to supply cold air introduced through the cold air suction hole into the freezer compartment, and having an interference prevention portion separated from the suction member to prevent interference with the suction member, and a water repellent portion treated with a water repellent is provided on a surface of the suction member adjacent to the interference prevention portion.

17 Claims, 17 Drawing Sheets

(51) Int. Cl.

| | |
|---|---|
| ***F25D 17/06*** | (2006.01) |
| ***F04D 29/60*** | (2006.01) |
| ***F04D 29/16*** | (2006.01) |
| ***F04D 19/00*** | (2006.01) |
| ***F25D 17/08*** | (2006.01) |
| *F25D 11/02* | (2006.01) |

(52) U.S. Cl.

CPC ..... *F04D 29/601* (2013.01); *F25D 17/065* (2013.01); *F25D 17/08* (2013.01); *F25D 21/04* (2013.01); *F25D 11/02* (2013.01); *F25D 17/067* (2013.01); *F25D 2317/061* (2013.01); *F25D 2317/066* (2013.01); *F25D 2317/0666* (2013.01); *F25D 2317/0681* (2013.01)

(56) References Cited

FOREIGN PATENT DOCUMENTS

| | | | |
|---|---|---|---|
| JP | 10-103846 | | 4/1998 |
| JP | 2000-199498 | | 7/2000 |
| JP | 2000199498 | A * | 7/2000 |
| JP | 2005-120991 | | 5/2005 |
| JP | 2009-257603 | | 11/2009 |
| JP | 2010-242597 | | 10/2010 |
| JP | 2015-145767 | | 8/2015 |
| WO | 2008/123679 | | 10/2008 |

OTHER PUBLICATIONS

European Office Action dated Feb. 17, 2020 in European Patent Application No. 17192759.3.

* cited by examiner (a)

(b)

(c)

(a)

(b)

(c)

BLOWER AND REFRIGERATOR HAVING THE SAME

CROSS-REFERENCE TO RELATED APPLICATIONS

This application claims the benefit of Korean Patent Application No. 10-2016-0121968, filed on Sep. 23, 2016 in the Korean Intellectual Property Office, the disclosure of which is incorporated herein by reference.

BACKGROUND

1. Field

Embodiments of the present disclosure relate to a blower with improved efficiency and a refrigerator having the same.

2. Description of the Related Art

Generally, a refrigerator is an apparatus configured to freshly store food by providing a storage compartment and a cold air supply device configured to supply cold air to the storage compartment.

A temperature of the storage compartment is maintained at a temperature within a predetermined range required to freshly store the food.

The storage compartment of the refrigerator is provided to have an open front surface, and the open front surface is closed by a door to maintain a stable temperature of the storage compartment.

The storage compartment is divided by a partition into a freezer compartment on a right side and a refrigerator compartment on a left side, and the freezer compartment and the refrigerator compartment are opened or closed by a freezer compartment door and a refrigerator compartment door, respectively.

A temperature of an inside of the storage compartment is maintained by receiving cold air from the cold air supply device, and the cold air supply device includes an evaporator configured to generate the cold air, a blower configured to supply the cold air generated from the evaporator to the storage compartment, and a cold air duct configured to receive the cold air supplied from the blower and discharge the cold air into the storage compartment.

The blower includes a suction member having a cold air suction hole through which the cold air is introduced, and a fan unit configured to supply the cold air introduced through the suction member to the storage compartment.

The fan unit includes a motor and blades rotated by the motor, and the blades are provided so that an end portion of each of the blades and the cold air suction hole are separated by a distance greater than or equal to a predetermined distance to prevent interference between the blade and the suction member.

When cold air below zero temperatures, which is generated by the evaporator, is circulated, dew is frozen and ice is generated on the end portions of the blades and an edge of the cold air suction hole such that the end portions of the blades have to be provided to be separated as far as possible from the cold air suction hole so that the ice generated on the end portions of the blades and the edge of the cold air suction hole does not interfere with rotation of the blades.

However, since a size of the blade has to be reduced to increase a separation distance between the end of the blade and the cold air suction hole, there is a problem in that efficiency of the blower is reduced.

SUMMARY

Therefore, it is an aspect of the present disclosure to provide a blower capable of improving efficiency thereof by allowing a separation distance between an end of the blade and a cold air suction hole to be minimized, and a refrigerator having the same.

In accordance with one aspect of the present disclosure, a refrigerator includes a body having a storage compartment including a refrigerator compartment and a freezer compartment, an evaporator provided behind the storage compartment and configured to generate cold air, and a blower configured to supply the cold air generated by the evaporator into the freezer compartment, wherein the blower includes a suction member having a cold air suction hole and a fan unit configured to supply cold air introduced through the cold air suction hole into the freezer compartment, and having an interference prevention portion separated from the suction member to prevent interference with the suction member, and a water repellent portion treated with a water repellent is provided on a surface of the suction member adjacent to the interference prevention portion.

The fan unit may include a motor, a hub connected to the motor by a rotary shaft, a plurality of blades provided to extend in a circumferential direction of the hub from the hub, and the interference prevention portion may be provided on an end portion of each of the blades.

The water repellent portion may be provided with a water repellent member which is treated with the water repellent and attached to an edge of the cold air suction hole adjacent to the interference prevention portion.

The water repellent member may be provided to be divided into a plurality of water repellent members, and each of the water repellent members may be attached to the edge of the cold air suction hole.

The water repellent portion may be provided so that an edge of the cold air suction hole adjacent to the interference prevention portion is coated with a water repellent material.

The fan unit, may include a motor, a base having a hub connected to the motor by a rotary shaft, a shroud in a ring shape, which is provided to be separated from the base in an axial direction of the rotary shaft and has an opening in a center portion thereof, a plurality of blades provided between the base and the shroud, and a base plate on which the motor is mounted.

The interference prevention portion may include a first interference prevention portion provided on the shroud adjacent to the suction member, and a second interference prevention portion provided on the base adjacent to the base plate.

The water repellent portion may include a first water repellent portion provided with the water repellent member which is treated with a water repellent and attached to the surface of the suction member adjacent to the first interference prevention portion, and a second water repellent portion provided with the water repellent member which is treated with a water repellent and attached to a surface of the base plate adjacent to the second interference prevention portion.

The first water repellent portion and the second water repellent portion may be provided so that the water repellent member is divided into a plurality of water repellent members and attached to the first water repellent portion and the second water repellent portion.

The water repellent portion may include a first water repellent portion provided such that a water repellent material is coated on the surface of the suction member adjacent to the first interference prevention portion, and a second water repellent portion provided such a water repellent material is coated on the surface of the base plate adjacent to the second interference prevention portion.

The fan unit may include a motor, a hub connected to the motor by a rotary shaft, a plurality of blades provided on an outer circumferential surface of the hub, and a base plate on which the motor is mounted.

The interference prevention portion may include a first interference prevention portion provided on end portion of the blade adjacent to the suction member and a second interference prevention portion provided on the hub adjacent to the base plate.

The water repellent portion may include a first water repellent portion provided with the water repellent member, which is treated with a water repellent and attached to the surface of the suction member adjacent to the first interference prevention portion, and a second water repellent portion provided with the water repellent member which is treated with a water repellent and attached to a surface of the base plate adjacent to the second interference prevention portion.

The first water repellent portion may be provided such that the water repellent member is divided into a plurality of water repellent members and attached to the first water repellent portion.

The water repellent portion may include a first water repellent portion provided such that a water repellent material is coated on the surface of the suction member adjacent to the first interference prevention portion, and a second water repellent portion provided such that a water repellent material is coated on the surface of the base plate adjacent to the second interference prevention portion.

In accordance with another aspect of the present disclosure, a blower includes a suction member having an air suction hole through which air is introduced, and a fan unit configured to induce the air introduced through the air suction hole to be discharged in a direction except for a direction of the air suction hole and having an interference prevention portion separated from the suction member to prevent interference with the suction member, wherein a water repellent portion treated with a water repellent is provided on a surface of the suction member adjacent to the interference prevention portion.

The fan unit may include a motor, a hub connected to the motor by a rotary shaft, and a plurality of blades provided to extend in a circumferential direction of the hub from the hub, and the interference prevention portion may be provided on an end portion of each of the blades.

The fan unit may include a motor, a fan connected to the motor by a rotary shaft, a base plate, and a base plate on which the motor is mounted, and the interference prevention may include a first interference prevention portion provided to be adjacent to the suction member, and a second interference prevention portion provided to be adjacent to the base plate.

The water repellent portion may include a first water repellent portion provided on the surface of the suction member adjacent to the first interference prevention portion and a second water repellent portion provided on a surface of the base plate adjacent to the second interference prevention.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, embodiments according to the present disclosure will be described in detail with reference to the accompanying drawings.

Figure 1:
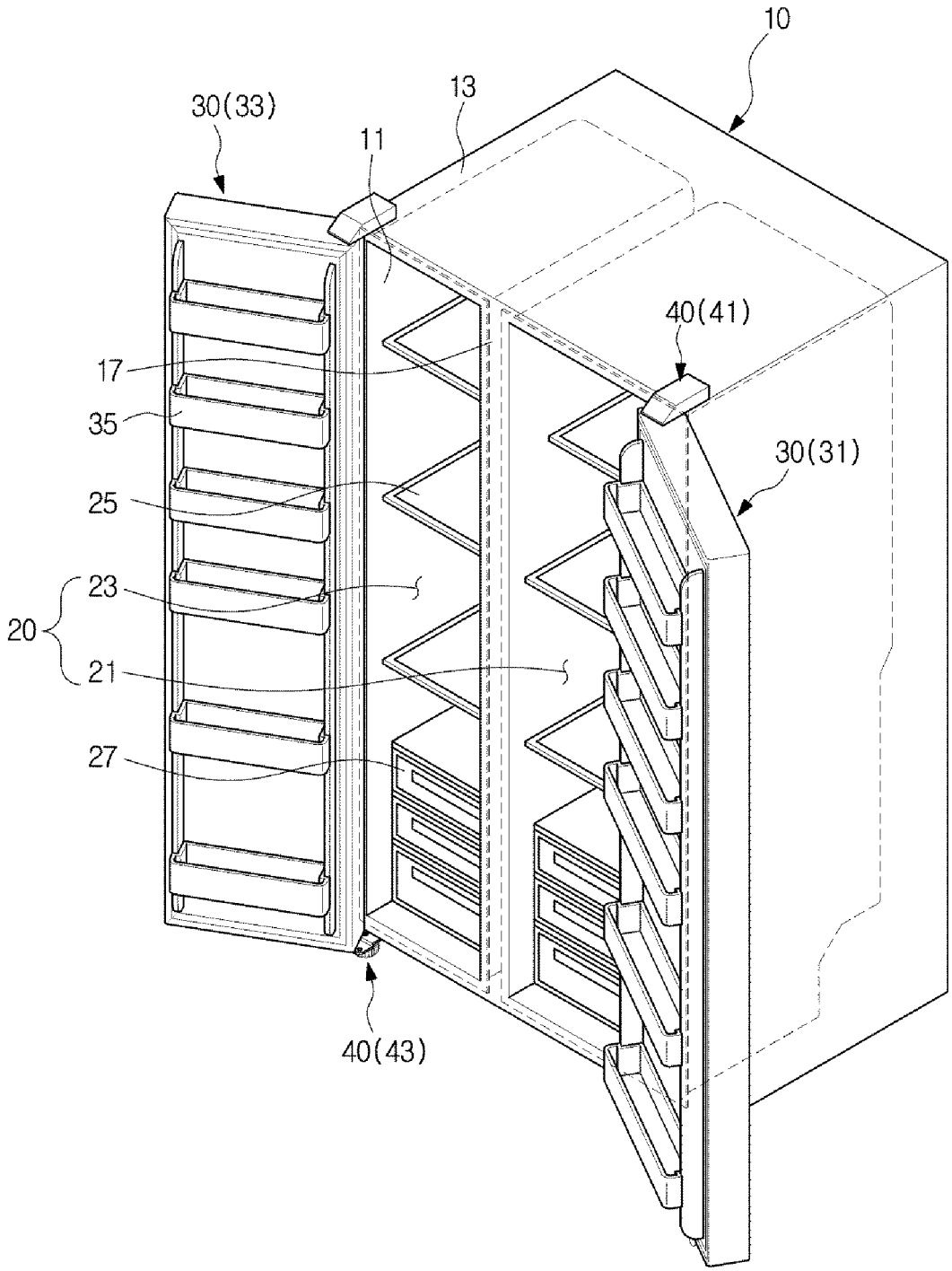
FIG. 1 is a perspective view of a refrigerator in accordance with one embodiment of the present disclosure.
Figure 2:
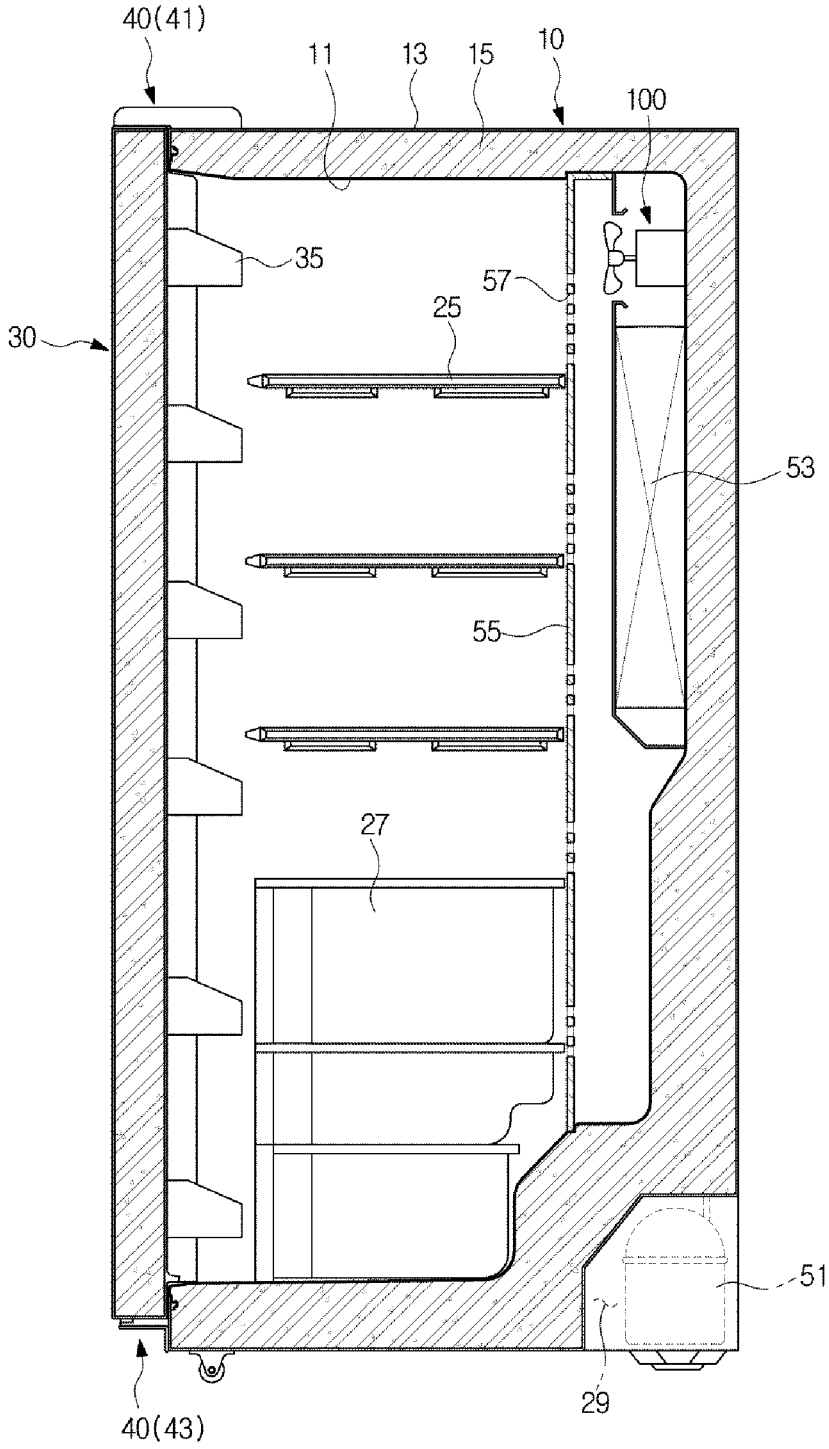
FIG. 2 is a side sectional view of the refrigerator in accordance with one embodiment of the present disclosure.

FIG. 1 is a perspective view of a refrigerator in accordance with one embodiment of the present disclosure, and FIG. 2 is a side sectional view of the refrigerator in accordance with one embodiment of the present disclosure.

As shown in FIGS. 1 to 2, the refrigerator includes a body 10 forming an exterior thereof, a storage compartment 20 provided in the body 10 and having an open front surface, a door 30 pivotally coupled to the body 10 so that the open front surface of the storage compartment 20 is opened or closed, and a hinge module 40 including an upper hinge 41 and a lower hinge 43 so that the door 30 is rotatably coupled to the body 10.

The body 10 includes an inner case 11 forming the storage compartment 20 and an outer case 13 forming the exterior, and an insulating material is foamed between the inner case 11 and the outer case 13 to prevent a discharge of cold air in the storage compartment 20.

Also, the body 10 includes a partition 17 configured to divide the storage compartment 20 into a refrigerator compartment 21 and a freezer compartment 23 located on left and right sides, and a machine room 29, in which a compressor 51 configured to compress a refrigerant and a condenser (not shown) configured to condense the compressed refrigerant are mounted, is provided in a lower rear part of the body 10.

The storage compartment 20 is laterally divided by the partition 17, and the refrigerator compartment 21 is provided on the right side of the body 10 and the freezer compartment 23 is provided on the left side of the body 10.

A plurality of shelves 25 and containers 27 may be provided in the storage compartment 20 to store food and the like.

The storage compartment 20 is opened and closed by the door 30 pivotably coupled to the body 10, and the refrigerator compartment 21 and the freezer compartment 23 laterally separated by the partition 17 are opened and closed by a refrigerator compartment door 31 and a freezer compartment door 33, respectively.

The refrigerator compartment door 31 and the freezer compartment door 33 may be pivotably coupled to the body 10 by the hinge module 40 including the upper hinge 41 provided on an upper portion of the body 10 and the lower hinge 43 provided on a lower portion of the body 10.

A plurality of door guards 35 are provided on rear surfaces of the refrigerator compartment door 31 and the freezer compartment door 33 to store food and the like.

A cold air supply device may include the compressor 51 and the condenser mounted in the machine room 29, an evaporator 53 mounted on a rear surface of the storage compartment 20 and configured to generate cold air, a blower 100 configured to supply the cold air generated by the evaporator 53 into the storage compartment 20, a cold air duct 55 having a plurality of cold air discharge holes 57 through which the cold air induced by the blower 100 is discharged into the storage compartment 20, etc.

Figure 3:
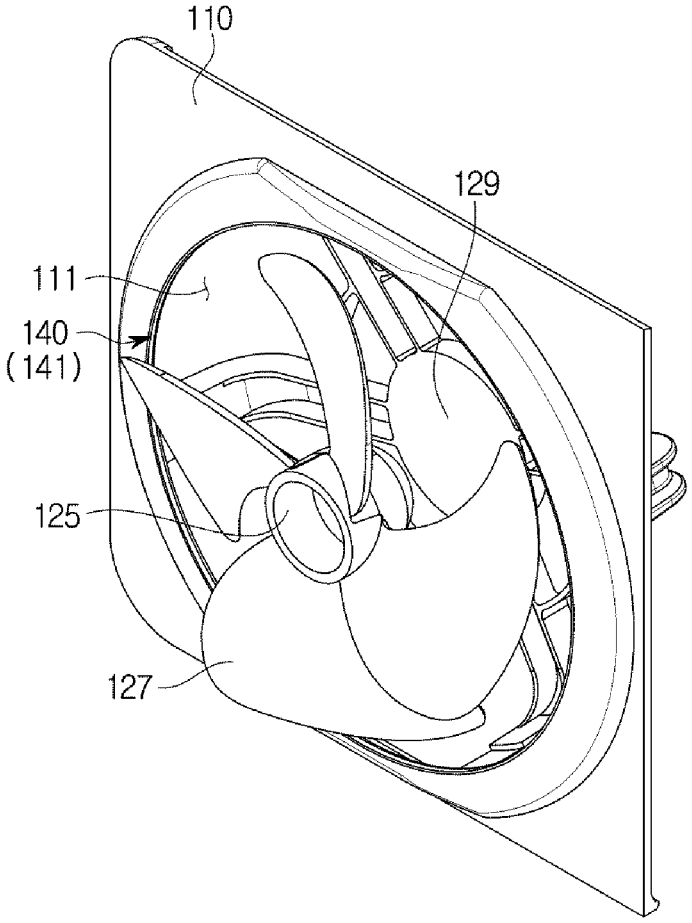
FIG. 3 is a perspective view of a blower in accordance with one embodiment of the present disclosure.
Figure 4:
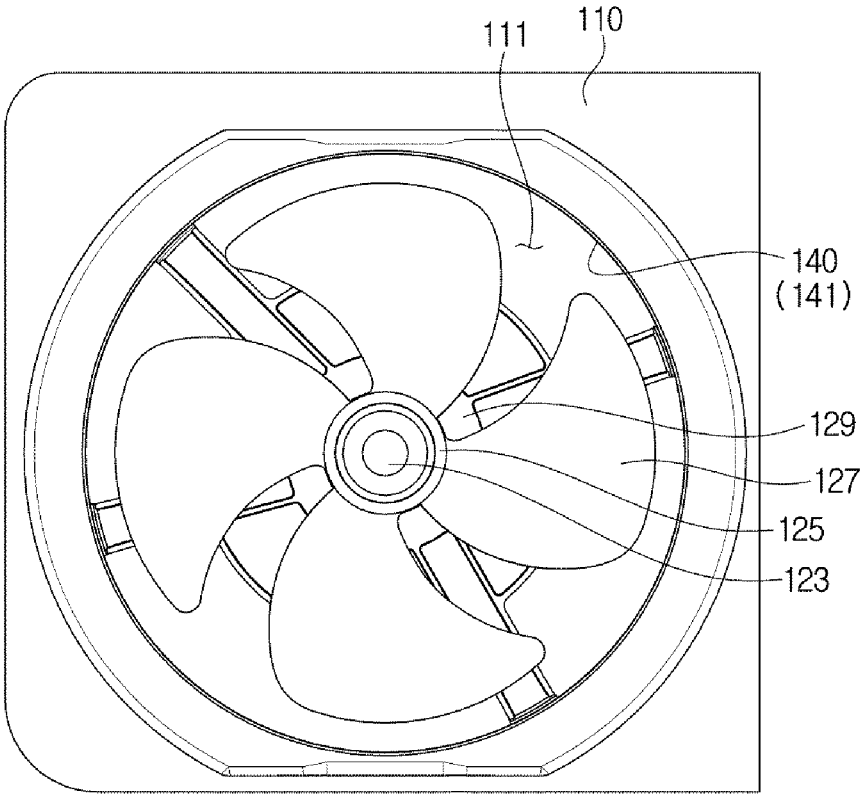
FIG. 4 is a front view of the blower in accordance with one embodiment of the present disclosure.
Figure 5:
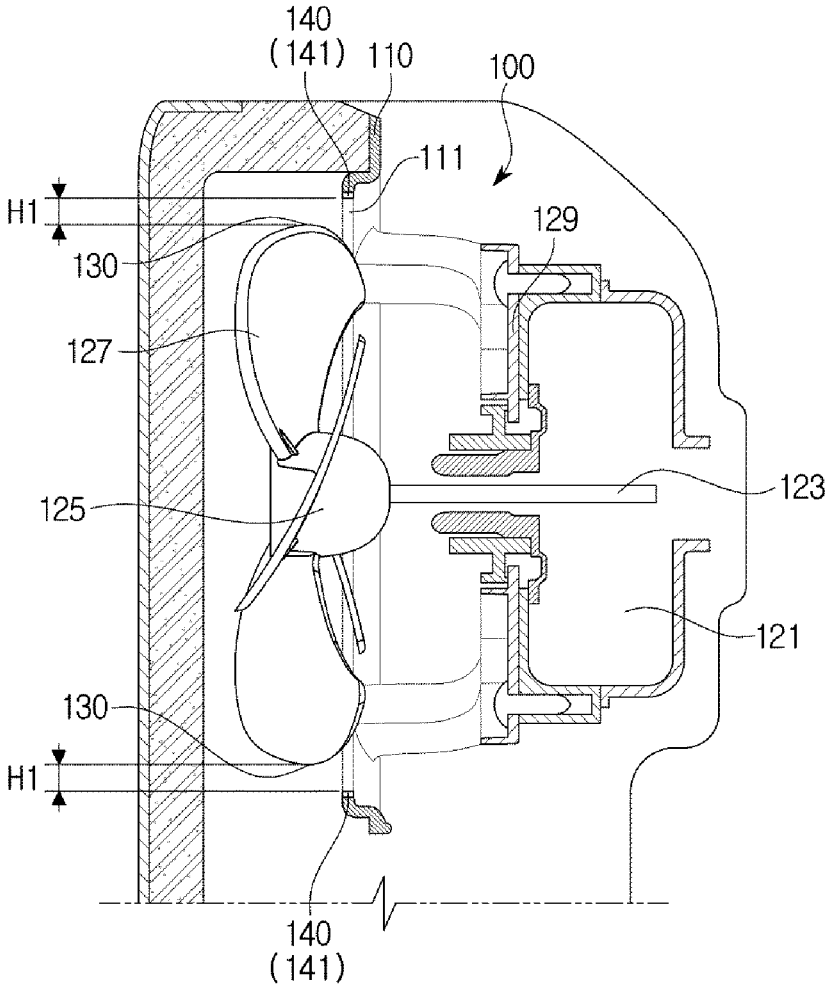
FIG. 5 is a side sectional view of the blower in accordance with one embodiment of the present disclosure.

FIG. 3 is a perspective view of a blower in accordance with one embodiment of the present disclosure, FIG. 4 is a front view of the blower in accordance with one embodiment of the present disclosure, and FIG. 5 is a side sectional view of the blower in accordance with one embodiment of the present disclosure.

As shown in FIGS. 3 to 5, the blower 100 may be provided as an axial flow fan including a suction member 110 into which cold air is introduced and a fan unit 120 configured to supply the cold air introduced through the suction member 110 to the storage compartment 20 (see FIG. 2).

A cold air suction hole 111 in a ring shape, through which cold air is introduced, is provided in the suction member 110, and the fan unit 120 is provided to be separated from the cold air suction hole 111 by a distance greater than or equal to a predetermined distance so that interference between the fan unit 120 and the cold air suction hole 111 is prevented.

Although a ring shape opening provided in the suction member 110 through which cold air is introduced into the suction member 110 is referred to as the cold air suction hole 111 when the blower 100 is used in the refrigerator, the ring shape opening provided in the suction member 110 may be referred to as an air suction hole when the blower 100 is used in a product in which air is introduced into the suction member 110 other than the refrigerator.

The fan unit 120 includes a motor 121, a hub 125 connected to the motor 121 by a rotary shaft 123, and a plurality of blades 127 provided to extend in a circumferential direction of the hub 125 from the hub 125.

The hub 125 located at the center of the plurality of blades 127 is connected to the motor 121 by the rotary shaft 123, and rotary power of the motor 121 is transmitted to the hub 125 through the rotary shaft 123 such that the hub 125 and the blades 127 rotate around the rotary shaft 123.

Cold air is introduced into the cold air suction hole 111 of the suction member 110 due to rotation of the blades 127, and the introduced cold air is discharged through the cold air discharge holes 57 provided in the cold air duct 55 and is supplied to the storage compartment 20 (see FIG. 2).

Interference prevention portions 130 provided to be separated from the cold air suction hole 111 by a distance greater than or equal to the predetermined distance are provided on end portions of the blades 127 rotated by the motor so that interference between the blades 127 and the cold air suction hole 111 is prevented.

When cold air below zero temperatures, which is generated by the evaporator 53, is circulated, dew may be frozen and ice may be generated on the interference prevention portions 130 of the blades 127 and an edge of the cold air suction hole 111.

Particularly, since a temperature of cold air generated by the evaporator 53 is lower when the cold air is supplied to the freezer compartment 23 among the storage compartments 20 by the blower 100 than when the cold air is supplied to the refrigerator compartment 21, when the cold air supplied to the freezer compartment 23 is circulated, dew may be easily frozen and ice may be generated on the interference prevention portions 130 of the blades 127 and the edge of the cold air suction hole 111 (see FIG. 2).

When ice is generated on the interference prevention portions 130 of the blades 127 and the edge of the cold air suction hole 111, the cold air suction hole 111 interferes with the rotation of the blades 127 due to the ice and efficiency of the blower 100 is reduced.

Accordingly, the interference prevention portion 130 and the edge of the cold air suction hole 111 have to be provided to be separated by a sufficient distance so that the cold air suction hole 111 does not interfere with the rotation of the blades 127 due to the ice generated on the interference prevention portions 130 of the blades 127 and the edge of the cold air suction hole 111.

Since a size of the blade 127 has to be reduced when a separation distance between the interference prevention portion 130 and the edge of the cold air suction hole 111 is increased so that the cold air suction hole 111 does not interfere with the rotation of the blades 127, the efficiency of the blower 100 is reduced.

A water repellent portion 140 treated with a water repellent is provided on the edge of the cold air suction hole 111 adjacent to the interference prevention portion 130 so that the distance between the interference prevention portion 130 of the blade 127 and the edge of the cold air suction hole 111 is minimized and the cold air suction hole 111 does not interfere with the rotation of the blades 127 due to the ice generated on the interference prevention portions 130 and the edge of the cold air suction hole 111.

When the water repellent portion 140 treated with the water repellent is provided on the edge of the cold air suction hole 111, since dew formed on the water repellent portion 140 flows more easily down than dew formed on a surface not treated with the water repellent, little dew is formed on the water repellent portion 140 and an amount of ice is small even when the dew is frozen and the ice is generated.

Since the amount of ice generated between the interference prevention portion 130 of the blade 127 and the edge of the cold air suction hole 111 is small, a distance H1 between the interference prevention portion 130 of the blade 127 and the edge of the cold air suction hole 111 may be minimized.

Since the distance H1 between the interference prevention portion 130 of the blade 127 and the edge of the cold air suction hole 111 can be minimized, the size of the blade 127 can be increased and the efficiency of the blower 100 can be improved.

The water repellent portion 140 provided on the edge of the cold air suction hole 111 may be provided with a water repellent member 141 which is treated with a water repellent and attached to the water repellent portion 140.

Figure 6:
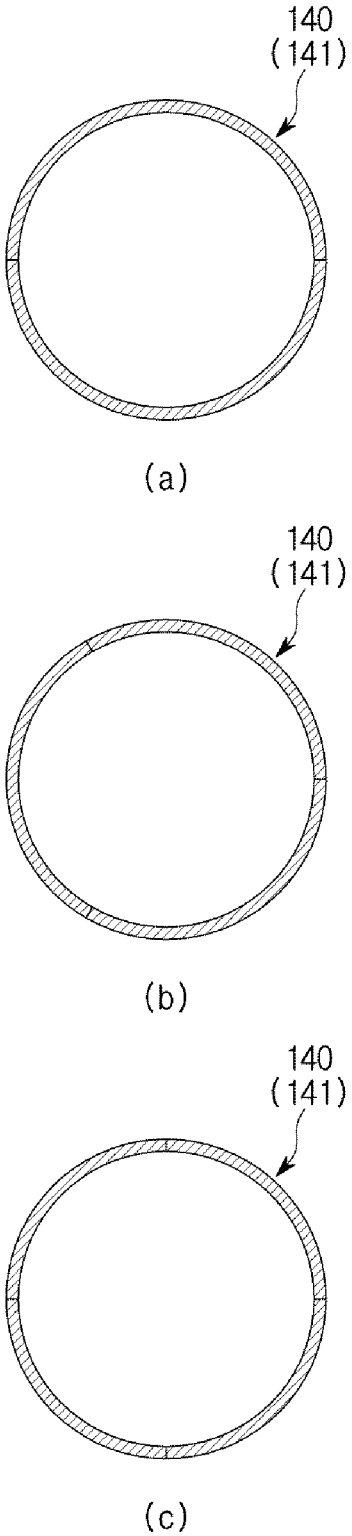
FIG. 6 is a view illustrating that a water repellent portion is provided to be divided into a plurality of water repellent members in accordance with one embodiment of the present disclosure.

FIG. 6 is a view illustrating that a water repellent portion is provided to be divided into a plurality of water repellent members in accordance with one embodiment of the present disclosure.

As shown in FIG. 6, when the water repellent portion 140 is provided with the water repellent member 141 which is treated with a water repellent and attached to the water repellent portion 140, since the water repellent member 141 may be provided on and attached to only necessary portions to be divided into a plurality of water repellent members 141 and each of the plurality of divided water repellent members 141 is attached to the edge of the cold air suction hole 111, the water repellent member 141 may be easily attached to the water repellent portion 140.

Although the water repellent member 141 is shown to be divided into two, three, or four water repellent members 141 in FIG. 6A to 6C, the embodiments are not limited thereto.

Figure 7:
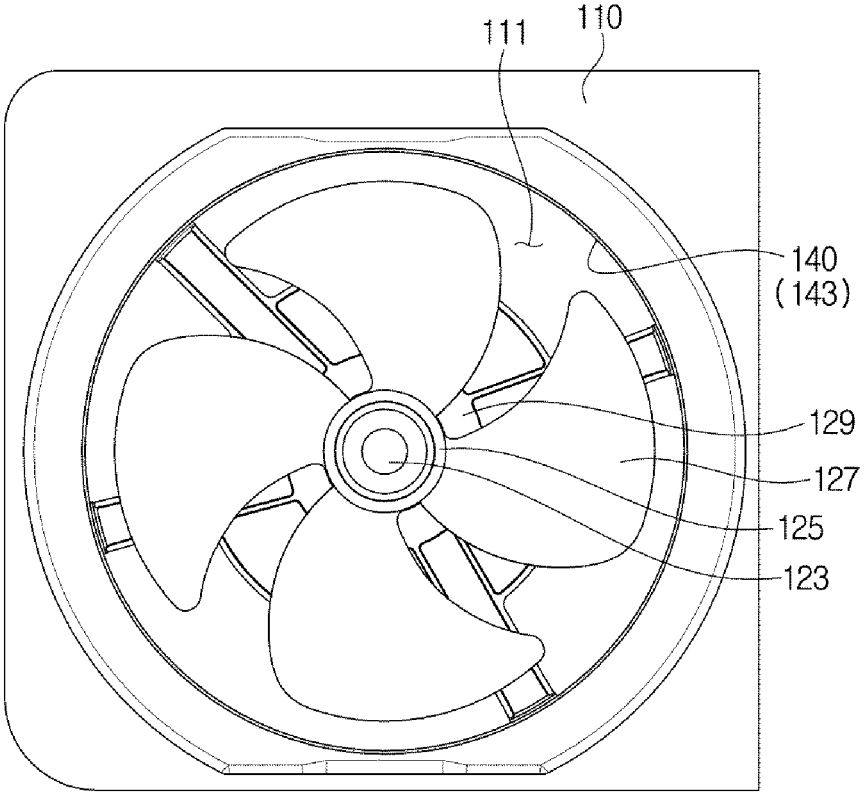
FIG. 7 is a view illustrating that the water repellent portion in accordance with one embodiment of the present disclosure is provided to be coated with a water repellent material.

FIG. 7 is a view illustrating that the water repellent portion in accordance with one embodiment of the present disclosure is provided to be coated with a water repellent material.

As shown in FIG. 7, the water repellent portion 140 coated with a water repellent material 143 may be provided on the edge of the cold air suction hole 111.

Next, a blower according to another embodiment will be described with reference to FIGS. 8 to 12.

Figure 8:
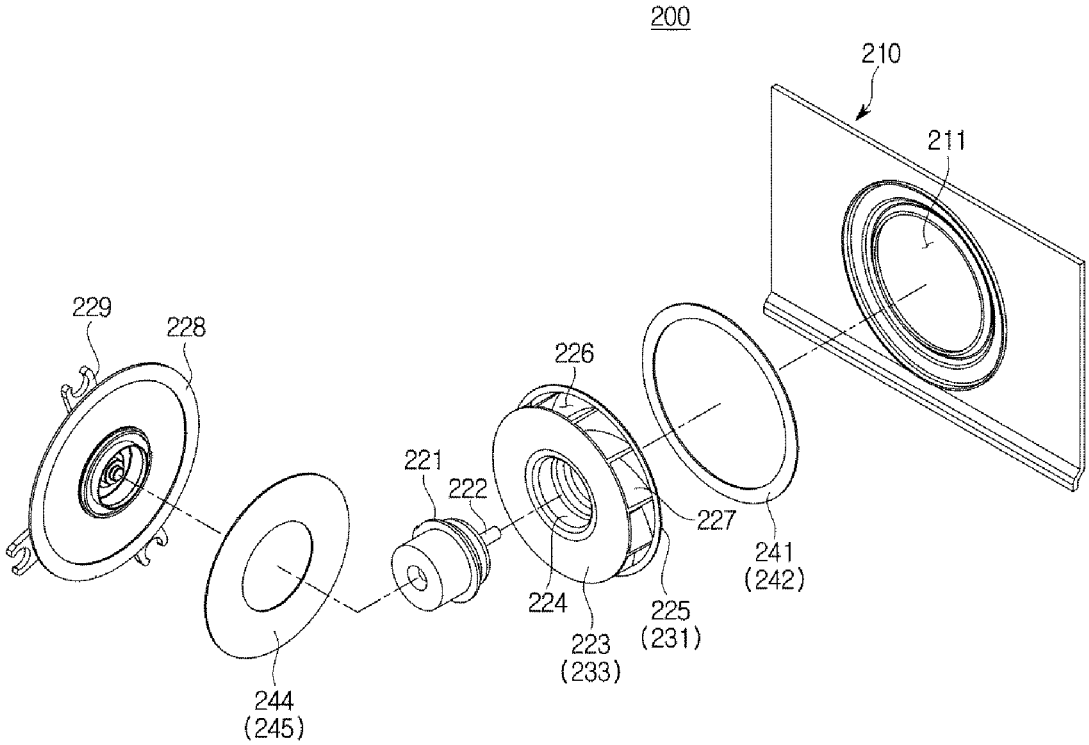
FIG. 8 is an exploded perspective view of a blower in accordance with another embodiment of the present disclosure.
Figure 9:
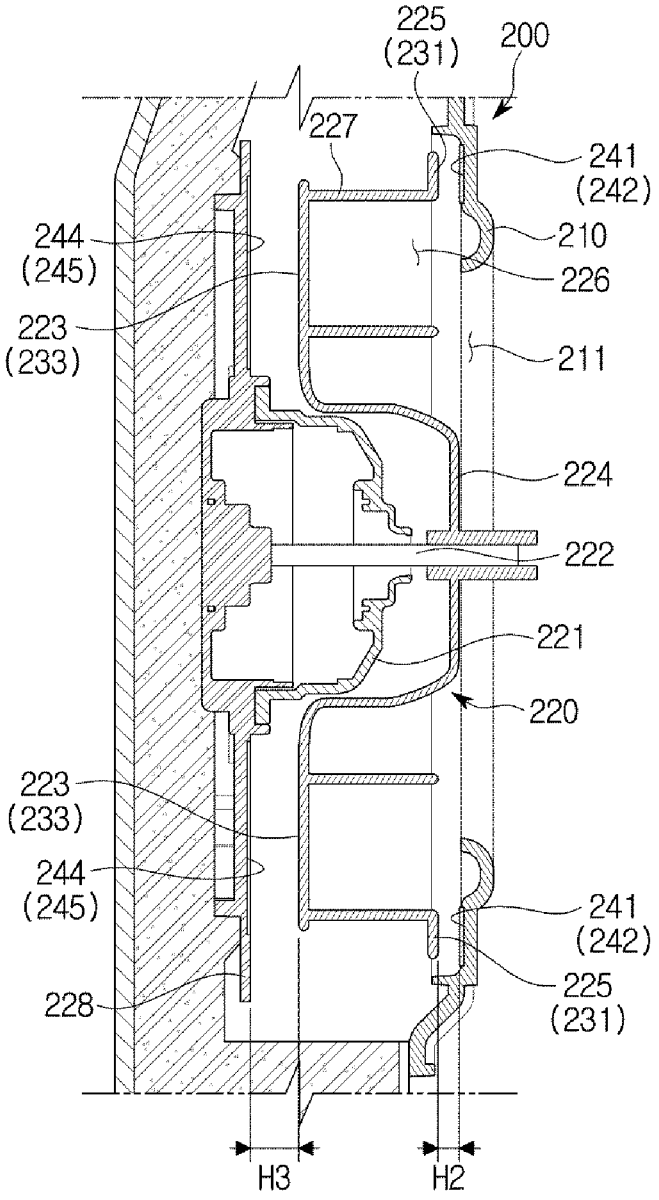
FIG. 9 is a cross-sectional view of the blower in accordance with another embodiment of the present disclosure.

FIG. 8 is an exploded perspective view of a blower in accordance with another embodiment of the present disclosure, and FIG. 9 is a cross-sectional view of the blower in accordance with another embodiment of the present disclosure.

As shown in FIGS. 8 and 9, a blower 200 may be provided as a centrifugal fan including a suction member 210 into which cold air is introduced and a fan unit 220 configured to supply the cold air introduced through the suction member 210 to the storage compartment 20 (see FIG. 2).

A cold air suction hole 211 in a ring shape, through which the cold air is introduced, is provided in the suction member 210.

Although a ring shape opening provided in the suction member 210 through which cold air is introduced into the suction member 210 is referred to as the cold air suction hole 211 when the blower 200 is used in a refrigerator, the ring shape opening provided in the suction member 210 may be referred to as an air suction hole when the blower 200 is used in a product in which air is introduced into the suction member 210 other than the refrigerator.

The fan unit 220 includes a motor 221, a base 223 having a hub 224 connected to the motor 221 by a rotary shaft 222, a shroud 225 in a ring shape, which is provided to be separated from the base 223 in an axial direction of the rotary shaft 222 and has an opening in a center portion thereof, a plurality of blades 227 provided between the base 223 and the shroud 225, and a base plate 228 on which the motor 221 is mounted.

A plurality of couplers 229 may be provided on the base plate 228 so that the base plate 228 may be coupled to other devices.

The hub 224 of the base 223 located at the center of the plurality of blades 227 is connected to the motor 221 by the rotary shaft 222, and rotary power of the motor 221 is transmitted to hub 224 through the rotary shaft 222 so that the base 223, shroud 225 and the blades 227 rotate around the rotary shaft 222.

Cold air is introduced into the cold air suction hole 211 of the suction member 210 due to rotation of the blades 227, and the introduced cold air is discharged through the cold air discharge holes 57 provided in the cold air duct 55 and may be supplied to the storage compartment 20.

Among the base 223, the shroud 225 and the blades 227 rotated by the motor 221, the shroud 225 is provided to be adjacent to the suction member 210, and the base 223 is provided to be adjacent to the base plate 228.

In the shroud 225 and the base 223 disposed adjacent to the suction member 210 and the base plate 228, respectively, interference prevention portions 231 and 233 are provided on one surface of the shroud 225 opposite the suction member 210 and one surface of the base 223 opposite the base plate 228, respectively, to prevent interference between the suction member 210 and the base plate 228.

The interference prevention portions 231 and 233 include the first interference prevention portion 231 provided on the one surface of the shroud 225 and the second interference prevention portion 233 provided on the one surface of the base 223.

When cold air below zero temperatures, which is generated by the evaporator 53, is circulated, dew may be frozen and ice may be generated on the first interference prevention portion 231, one surface of the suction member 210 opposite the first interference prevention portion 231, the second interference prevention portion 233, and one surface of the base plate 228 opposite the second interference prevention portion 233.

Particularly, since a temperature of cold air generated by the evaporator 53 is lower when the cold air is supplied to the freezer compartment 23 among the storage compartments 20 by the blower 200 than when the cold air is supplied to the refrigerator compartment 21, when the cold air supplied to the freezer compartment 23 is circulated, dew may be easily frozen and ice may be generated on the first interference prevention portion 231, the one surface of the suction member 210 opposite the first interference prevention portion 231, the second interference prevention portion 233, and the one surface of the base plate 228 opposite the second interference prevention portion 233 (see FIG. 2).

When ice is generated between the first interference prevention portion 231 and the suction member 210 and generated between the second interference prevention portion 233 and the base plate 228, the suction member 210 and the base plate 228 interfere with rotation of the fan unit 220 due to the ice, and efficiency of the blower 200 is reduced.

Accordingly, distances between the first interference prevention portion 231 and the suction member 210 and between the second interference prevention portion 233 and the base plate 228 have to be adequately provided so that the ice generated between the first interference prevention portion 231 and the suction member 210 and between the second interference prevention portion 233 and the base plate 228 does not interfere with the rotation of the fan unit 220.

Since a size of the blade 227 has to be reduced when the separation distances between the first interference prevention portion 231 and suction member 210 and between the second interference prevention portion 233 and the base plate 228 are increased so that the suction member 210 and the base plate 228 do not interfere with the rotation of the fan unit 220, the efficiency of the blower 200 is reduced.

Also, cold air introduced in the axial direction of the rotary shaft 222 is discharged in a circumferential direction of the rotary shaft 222, and some of the discharged cold air is reintroduced through separation gaps between the first interference prevention portion 231 and the suction member 210 and between the second interference prevention portion 233 and the base plate 228 such that the efficiency of the blower 200 is reduced.

Since the amount of reintroduced cold air is increased when the separation gaps between the first interference prevention portion 231 and the suction member 210 and between the second interference prevention portion 233 and the base plate 228 are widened, the efficiency of the blower 200 is further reduced.

Water repellent portions 241 and 244 treated with a water repellent are provided on the one surface of the suction member 210 opposite the first interference prevention portion 231 and the one surface of the base plate 228 opposite the second interference prevention portion 233 so that the distances between the first interference prevention portion 231 and suction member 210 and between the second interference prevention portion 233 and the base plate 228 are minimized and ice generated on the first interference prevention portion 231, the suction member 210, the second interference prevention portion 233, and the base plate 228 does not interfere with the rotation of the fan unit 220.

The water repellent portions 241 and 244 include the first water repellent portion 241 provided on the one surface of the suction member 210 opposite the first interference prevention portion 231 and the second water repellent portion 244 provided on the one surface of the base plate 228 opposite the second interference prevention portion 233.

When the water repellent portions 241 and 244 treated with the water repellent are provided on the one surface of the suction member 210 opposite the first interference prevention portion 231 and the one surface of the base plate 228 opposite the second interference prevention portion 233, since dew formed on the water repellent portions 241 and 244 flows more easily down than dew formed on a surface not treated with the water repellent, little dew is formed on the water repellent portions 241 and 244 so that an amount of ice is small even when the dew is frozen and the ice is generated.

Since the amount of ice generated on the water repellent portions 241 and 244 is small, a distance H2 between the first water repellent portion 241 and the first interference prevention portion 231 and a distance H3 between second water repellent portion 244 and the second interference prevention portion 233 may be minimized.

Since the distance H2 between the first water repellent portion 241 and the first interference prevention portion 231 and the distance H3 between second water repellent portion 244 and the second interference prevention portion 233 may be minimized, the size of the blade 227 may be increased and the efficiency of the blower 200 can be improved.

The first water repellent portion 241 and the second water repellent portion 244 may be respectively provided with water repellent members 242 and 245 which are treated with a water repellent and attached to the first water repellent portion 241 and the second water repellent portion 244.

Figure 10:
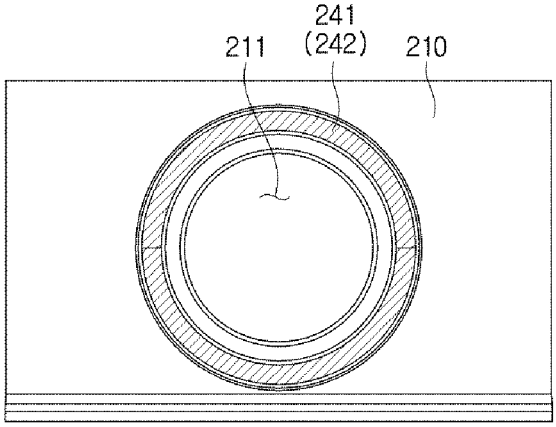
FIG. 10 is a view illustrating that a first water repellent portion is provided to be divided into a plurality of water repellent members in accordance with another embodiment of the present disclosure.
Figure 10:
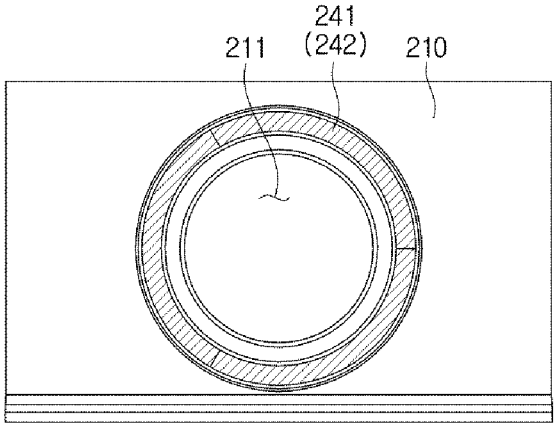
Figure 10:
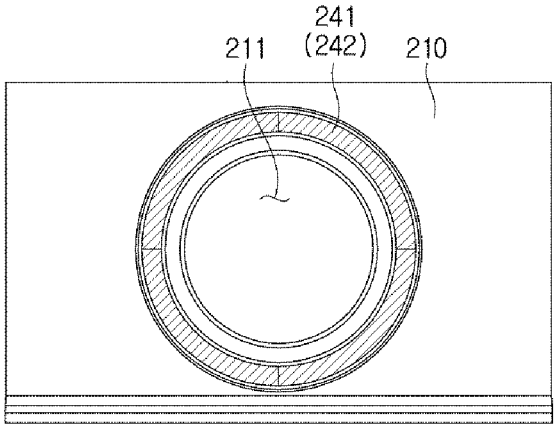
Figure 11:
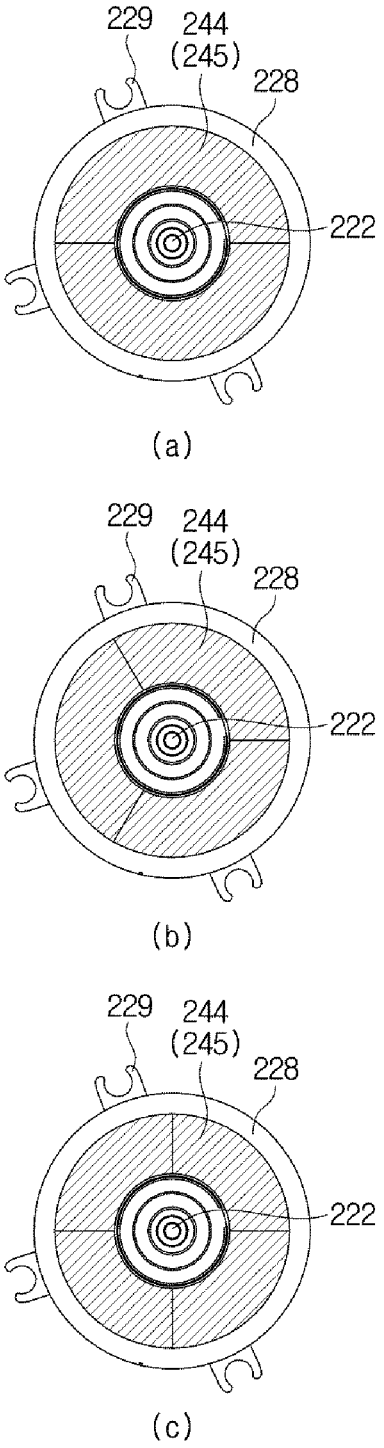
FIG. 11 is a view illustrating that a second water repellent portion is provided to be divided into a plurality of water repellent members in accordance with another embodiment of the present disclosure.

FIG. 10 is a view illustrating that a first water repellent portion is provided to be divided into a plurality of water repellent members in accordance with another embodiment of the present disclosure, and FIG. 11 is a view illustrating that a second water repellent portion is provided to be divided into a plurality of water repellent members in accordance with another embodiment of the present disclosure.

As shown in FIGS. 10 and 11, when a first water repellent portion 241 and a second water repellent portion 244 are respectively provided with water repellent members 242 and 245 which are treated with a water repellent and attached to the first water repellent portion 241 and the second water repellent portion 244, since the water repellent members 242 and 245 may be attached to and provided on only necessary portions to be divided into a plurality of water repellent members 242 and 252 and the plurality of divided water repellent members 242 and 245 is attached to a suction member 210 or a base plate 228, the water repellent members 242 and 245 may be easily attached to the suction member 210 or the base plate 228.

Although the water repellent member 242 is shown to be divided into two, three, and four water repellent members 242 in FIG. 10A to 10C and the water repellent member 245 is shown to be divided into two, three, and four water repellent members 245 in FIG. 11A to 11C, the embodiments are not limited thereto.

Figure 12:
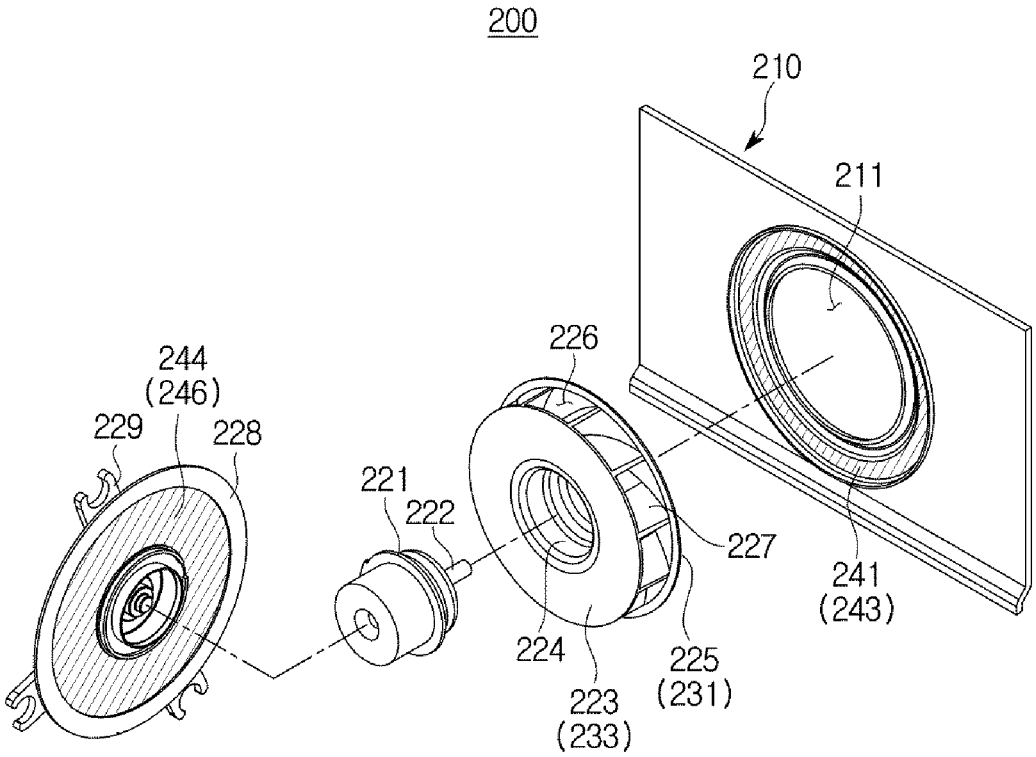
FIG. 12 is a view illustrating that the first water repellent portion and the second water repellent portion in accordance with another embodiment of the present disclosure are provided to be coated with water repellent materials.

FIG. 12 is a view illustrating that the first water repellent portion and the second water repellent portion in accordance with another embodiment of the present disclosure are provided to be coated with water repellent materials.

As shown in FIG. 12, a first water repellent portion 241 and a second water repellent portion 244 which are coated with water repellent materials 243 and 246 may be provided.

Although both the first water repellent portion 241 and the second water repellent portion 244 are shown to be coated with the water repellent materials 243 and 246 and provided in the drawing, only one of the first water repellent portion 241 and the second water repellent portion 244 may be coated with the water repellent material and provided and the other water repellent portion may be provided with a water repellent member treated with a water repellent.

Next, a blower according to still another embodiment will be described with reference to FIGS. 13 to 17.

Figure 13:
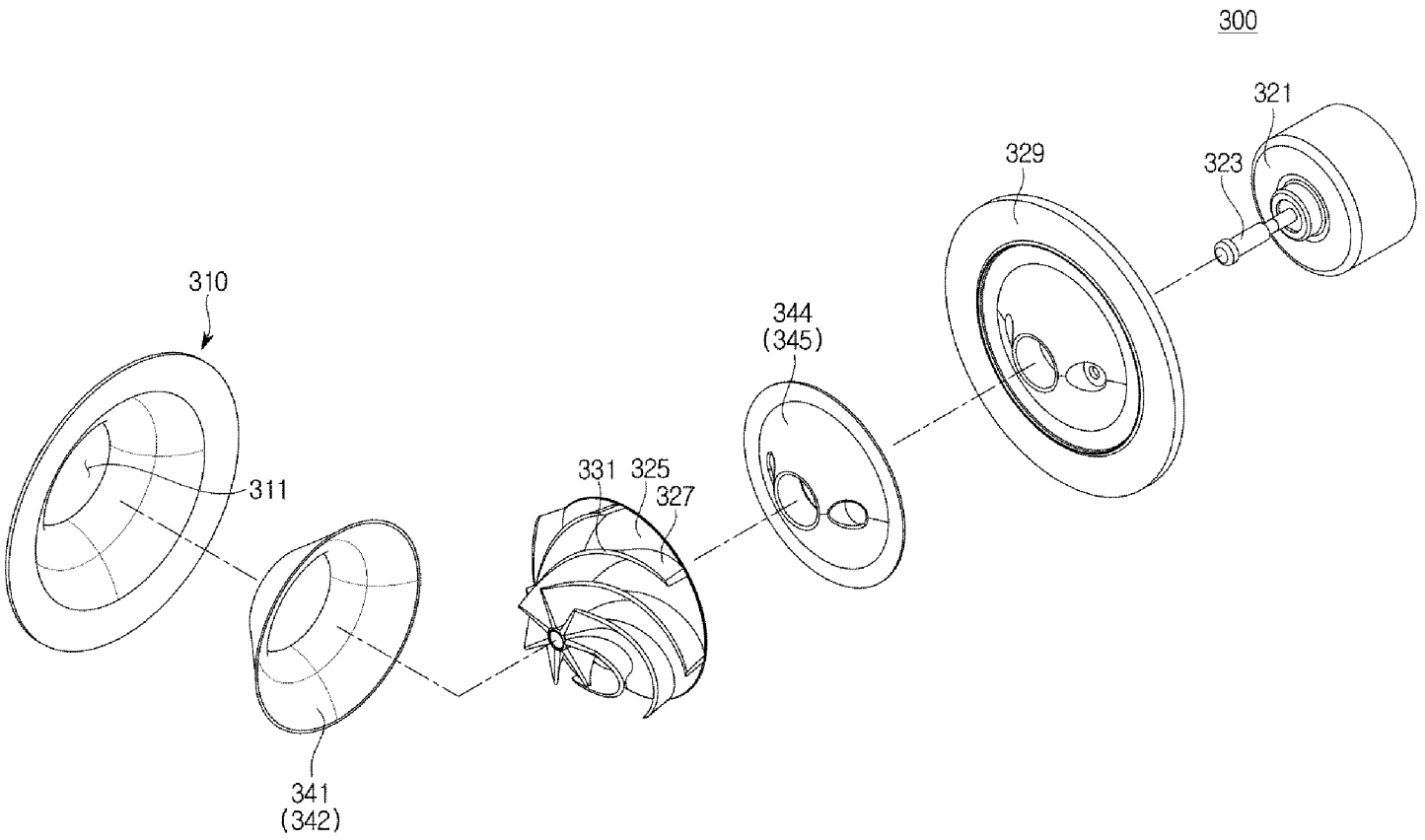
FIG. 13 is an exploded perspective view of a blower in accordance with still another embodiment of the present disclosure.
Figure 14:
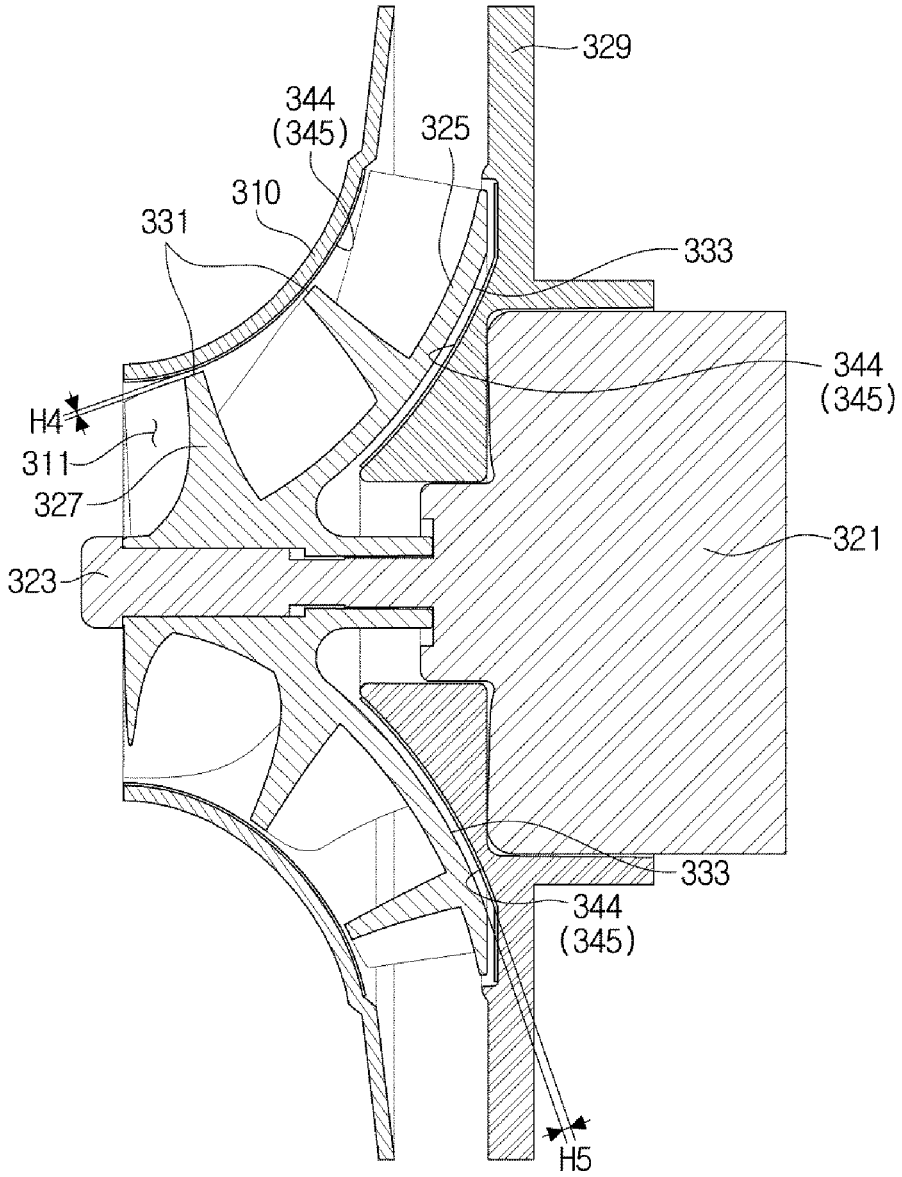
FIG. 14 is a cross-sectional view of the blower in accordance with still another embodiment of the present disclosure.

FIG. 13 is an exploded perspective view of a blower in accordance with still another embodiment of the present disclosure, and FIG. 14 is a cross-sectional view of the blower in accordance with still another embodiment of the present disclosure.

As shown in FIGS. 13 and 14, a blower 300 may be provided as a mixed flow fan including a suction member 310 into which cold air is introduced and a fan unit 320 configured to supply the cold air introduced through the suction member 310 to a storage compartment 20 (see FIG. 2).

A ring shape cold air suction hole 311 through which cold air is introduced is provided in the suction member 310.

Although a ring shape opening provided in the suction member 310 through which cold air is introduced into the suction member 310 is referred to as the cold air suction hole 311 when the blower 300 is used in a refrigerator, the ring shape opening provided in the suction member 310 may be referred to as an air suction hole when the blower 300 is used in a product in which air is introduced into the suction member 310 other than the refrigerator.

The fan unit 320 includes a motor 321, a hub 325 connected to the motor 321 by a rotary shaft 323, a plurality of blades 327 provided on an outer circumferential surface of the hub 325, and a base plate 329 on which the motor 321 is mounted.

When rotary power of the motor 321 is transmitted to the hub 325 and the hub 325 rotates around the rotary shaft 323, the blades 327 formed on the outer circumferential surface of the hub 325 are also rotated together with the hub 325.

Cold air is introduced into the cold air suction hole 311 of the suction member 310 due to rotation of the blades 327, and the introduced cold air is discharged through the cold air discharge holes 57 provided in the cold air duct 55 and may be supplied to the storage compartment 20.

An end portion of the blade 327 rotated by the motor 221 is provided to be adjacent to the suction member 310, and a surface opposite a surface of the hub 325 on which the blades 327 are provided is provided to be adjacent to the base plate 329.

Interference prevention portions 331 and 333 are respectively provided on the end portion of the blade 327, which is disposed adjacent to the suction member 310 and the base plate 329, and the surface opposite the surface of the hub 325 on which the blades 327 are provided so that the end portion of the blade 327, which is disposed adjacent to the suction member 310 and the base plate 329, and the surface opposite the surface of the hub 325 on which the blades 327 are provided are provided to prevent interference between the suction member 310 and the base plate 329.

The interference prevention portions 331 and 333 include the first interference prevention portion 331 provided on the end portion of the blade 327 and the second interference prevention portion 333 provided on one surface of the hub 325.

When cold air below zero temperatures, which is generated by the evaporator 53, is circulated, dew may be frozen and ice may be generated on the first interference prevention portion 331, one surface of the suction member 310 opposite the first interference prevention portion 331, the second interference prevention portion 333, and one surface of the base plate 329 opposite the second interference prevention portion 333.

Particularly, as a temperature of cold air generated by the evaporator 53 is lower when the cold air is supplied to a freezer compartment 23 among the storage compartments 20 by the blower 300 than when the cold air is supplied to a refrigerator compartment 21, when the cold air supplied to the freezer compartment 23 is circulated, dew may be easily frozen and ice may be generated on the first interference prevention portion 331, the one surface of the suction member 310 opposite the first interference prevention portion 331, the second interference prevention portion 333, and the one surface of the base plate 329 opposite the second interference prevention portion 333 (see FIG. 2).

Distances between the first interference prevention portion 331 and the suction member 310 and between the second interference prevention portion 333 and the base plate 329 have to be adequately provided so that the ice generated between the first interference prevention portion 331 and suction member 310 and between the second interference prevention portion 333 and the base plate 329 does not interfere with rotation of the fan unit 320.

Since a size of the blade 327 has to be reduced when the separation distances between the first interference prevention portion 331 and suction member 310 and between the second interference prevention portion 333 and the base plate 329 are increased so that the suction member 310 and the base plate 329 do not interfere with the rotation of the fan unit 320, the efficiency of the blower 300 is reduced.

Water repellent portions 341 and 344 treated with a water repellent are provided on the one surface of the suction member 310 opposite the first interference prevention portion 331 and the one surface of the base plate 329 opposite the second interference prevention portion 333 so that the distances between the first interference prevention portion 331 and suction member 310 and between the second interference prevention portion 333 and the base plate 329 are minimized and ice generated on the first interference prevention portion 331, suction member 310, the second interference prevention portion 333, and the base plate 329 does not interfere with the rotation of the fan unit 320.

The water repellent portions 341 and 344 include the first water repellent portion 341 provided on the one surface of the suction member 310 opposite the first interference prevention portion 331 and the second water repellent portion 344 provided on the one surface of the base plate 329 opposite the second interference prevention portion 333.

When the water repellent portions 341 and 344 treated with the water repellent are provided on the one surface of the suction member 310 opposite the first interference prevention portion 331 and the one surface of the base plate 329 opposite the second interference prevention portion 333, as dew formed on the water repellent portions 341 and 344 flows more easily down than dew formed on a surface not treated with the water repellent, little dew is formed on the water repellent portions 341 and 344 such that an amount of ice is small even when the dew is frozen and the ice is generated.

Since the amount of ice generated on the water repellent portions 341 and 344 is small, a distance H4 between the first water repellent portion 341 and the first interference prevention portion 331 and a distance H5 between second water repellent portion 344 and the second interference prevention portion 333 may be minimized.

Since the distance H4 between the first water repellent portion 341 and the first interference prevention portion 331 and the distance H5 between second water repellent portion 344 and the second interference prevention portion 333 may be minimized, the size of the blade 327 can be increased and the efficiency of the blower 300 can be improved.

The first water repellent portion 341 and the second water repellent portion 344 may be respectively provided with water repellent members 342 and 345 which are treated with a water repellent and attached to the first water repellent portion 341 and the second water repellent portion 344.

Figure 15:
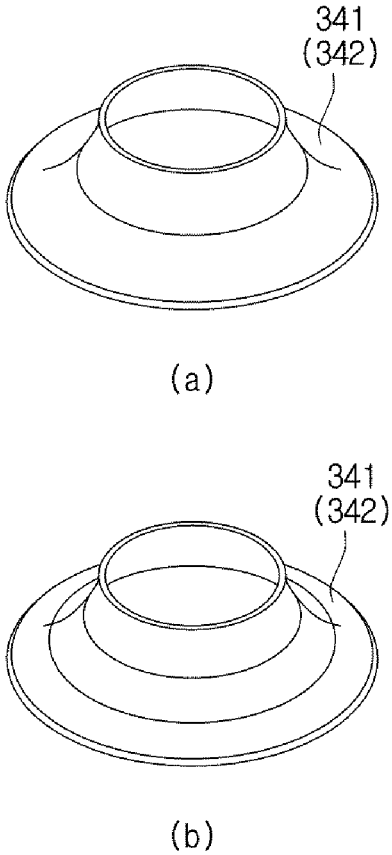
FIG. 15 is a view illustrating that a first water repellent portion is provided to be divided into a plurality of water repellent members in an axial direction of a rotary shaft in accordance with still another embodiment of the present disclosure.
Figure 16:
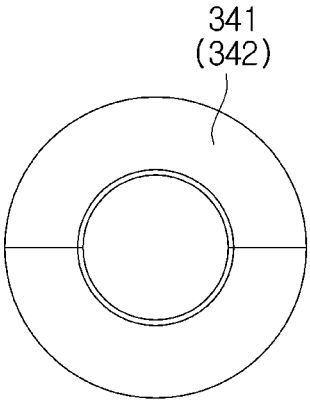
FIG. 16 is a view illustrating that the first water repellent portion in accordance with still another embodiment of the present disclosure is provided to be divided into a plurality of water repellent members in a radial direction of the rotary shaft.
Figure 16:
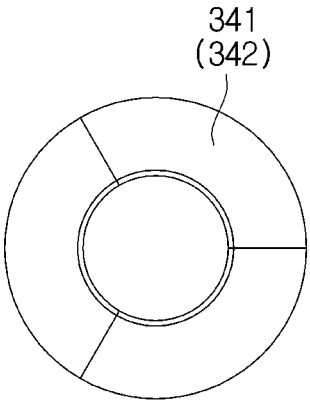
Figure 16:
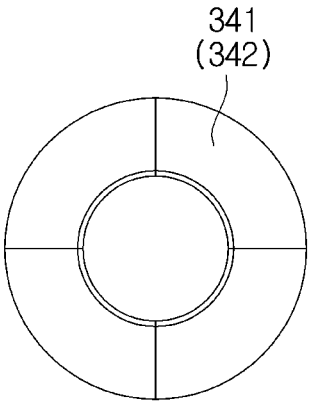

FIG. 15 is a view illustrating that a first water repellent portion is provided to be divided into a plurality of water repellent members in an axial direction of a rotary shaft in accordance with still another embodiment of the present disclosure, and FIG. 16 is a view illustrating that the first water repellent portion in accordance with still another embodiment of the present disclosure is provided to be divided into a plurality of water repellent members in a radial direction of the rotary shaft.

When a first water repellent portion 341 is provided with a water repellent member 342 treated with a water repellent, the water repellent member 342 is provided to be divided into a plurality of water repellent members 342 in a shaft direction of the rotary shaft 323, as shown in FIG. 15, or the water repellent member 342 is provided to be divided into a plurality of water repellent members 342 in a radial direction of the rotary shaft 323, as shown in FIG. 16.

Since the first water repellent portion 341 may be provided on and attached to only necessary portions to be divided into a plurality of water repellent portions 341 and each of the plurality of divided water repellent members 342 is attached to the suction member 310 and the base plate 329, the first water repellent portion 341 may be easily attached to the suction member 310 and the base plate 329.

Although the water repellent member 342 is shown to be divided into two and three water repellent members 342 in FIGS. 15A and 15B and the water repellent member 342 is shown to be divided into two, three, and four water repellent members 342 in FIG. 16A to 16C, the embodiments are not limited thereto.

Figure 17:
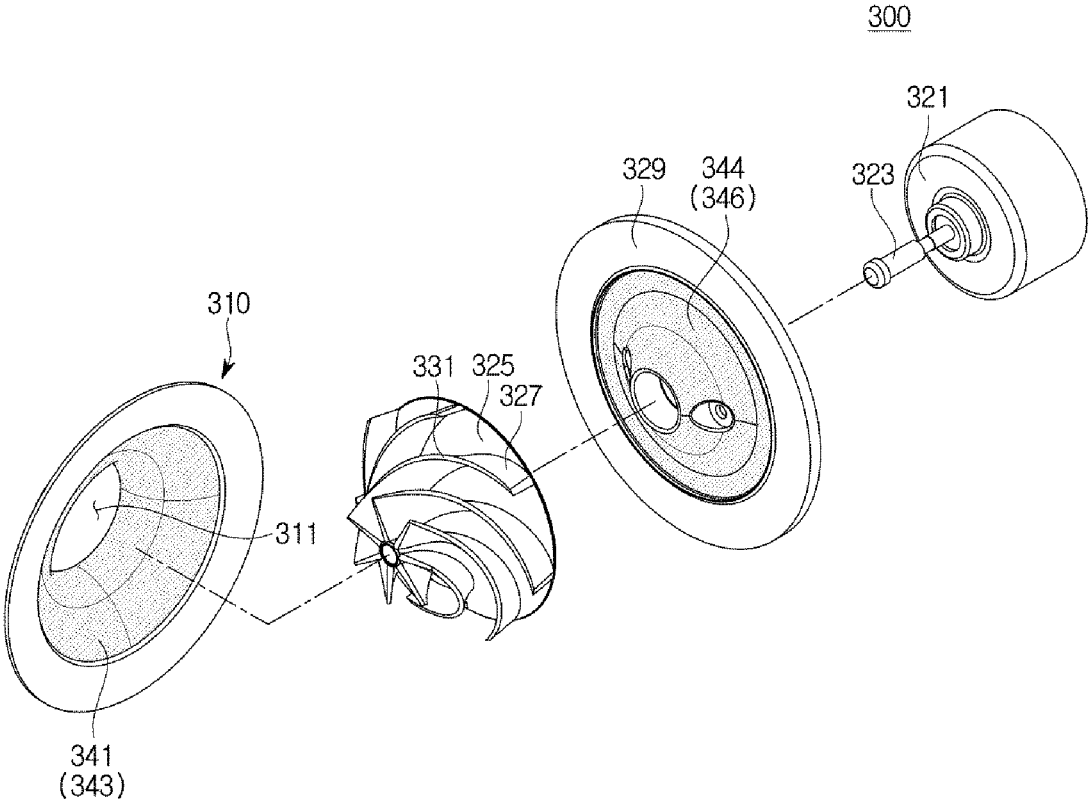
FIG. 17 a view illustrating that the first water repellent portion and a second water repellent portion in accordance with still another embodiment of the present disclosure are provided to be coated with water repellent materials.

FIG. 17 a view illustrating that the first water repellent portion and a second water repellent portion are provided to be coated with water repellent materials in accordance with still another embodiment of the present disclosure.

As shown in FIG. 17, a first water repellent portion 341 and a second water repellent portion 344 coated with water repellent materials 343 and 346 may be provided.

Although both the first water repellent portion 341 and the second water repellent portion 344 are shown as being coated with the water repellent materials 343 and 346 and provided in the drawing, only one of the first water repellent portion 341 and the second water repellent portion 344 may be coated with the water repellent material and provided and the other one of the water repellent portions may be provided with a water repellent member treated with a water repellent.

As is apparent from the above description, efficiency of a blower can be improved so that a separation distance between an end of the blade and a suction member can be minimized.

Although particular shapes and directions of a blower and a refrigerator having the same have been mainly described while describing the blower and the refrigerator having the same with reference to the accompanying drawings, those skilled in the art should understand that the present disclosure may be modified and changed and such modifications and the changes are included in the scope of the present disclosure.

What is claimed is:

1. A refrigerator comprising:

a body including a freezer compartment;

an evaporator provided outside the freezer compartment and configured to generate cold air; and a blower configured to supply the cold air generated by the evaporator into the freezer compartment, wherein the blower includes:

a suction member having a cold air suction hole; and a fan configured to supply the cold air, generated by the evaporator and introduced through the cold air suction hole, into the freezer compartment, and the fan having an interference prevention portion provided on an outside end of the fan and configured to prevent an interference of the fan with the suction member, wherein the suction member further includes a water repellent surface provided adjacent to the interference prevention portion of the fan, to reduce an amount of ice formed on the water repellent surface, and the water repellent surface is provided with a water repellent member which is treated with a water repellent and attached to an edge of the cold air suction hole adjacent to the interference prevention portion.

2. The refrigerator according to claim 1, wherein:

the fan includes a motor, a hub connected to the motor by a rotary shaft, and a plurality of blades provided to extend in a radial direction from the hub; and the interference prevention portion is provided furthest from the hub of each of the plurality of blades.

3. The refrigerator according to claim 2, wherein the water repellent member is provided to be divided into a plurality of water repellent members, and each of plurality of the water repellent members is attached to the edge of the cold air suction hole.

4. The refrigerator according to claim 1, wherein the fan further includes a motor, a base having a hub connected to the motor by a rotary shaft, a shroud in a ring shape, which is provided to be separated from the base in an axial direction of the rotary shaft and has an opening in a center portion of the shroud, a plurality of blades provided between the base and the shroud, and a base plate on which the motor is mounted.

5. The refrigerator according to claim 4, wherein the interference prevention portion includes a first interference prevention portion provided on the shroud adjacent to the suction member and a second interference prevention portion provided on the base adjacent to the base plate.

6. The refrigerator according to claim 5, wherein the water repellent surface includes:

a first water repellent surface provided with a water repellent member which is treated with a water repellent and attached to the surface of the suction member adjacent to the first interference prevention portion; and a second water repellent surface provided with the water repellent member which is treated with the water repellent and attached to a surface of the base plate adjacent to the second interference prevention portion.

7. The refrigerator according to claim 6, wherein the first water repellent surface and the second water repellent surface are provided so that the water repellent member is divided into a plurality of water repellent members and attached to the first water repellent surface and the second water repellent surface.

8. The refrigerator according to claim 5, wherein the water repellent surface includes:

a first water repellent surface provided such that a water repellent material is coated on a surface of the suction member adjacent to the first interference prevention portion; and a second water repellent surface provided such that the water repellent material is coated on a surface of the base plate adjacent to the second interference prevention portion.

9. The refrigerator according to claim 1, wherein the fan further includes:

a motor;

a hub connected to the motor by a rotary shaft;

a plurality of blades provided on an outer circumferential surface of the hub; and a base plate on which the motor is mounted.

10. The refrigerator according to claim 9, wherein the interference prevention portion includes:

a first interference prevention portion provided on an end portion adjacent to the suction member of each of the plurality of blades; and a second interference prevention portion provided on the hub adjacent to the base plate.

11. The refrigerator according to claim 10, wherein the water repellent surface includes:

a first water repellent surface provided with a water repellent member which is treated with a water repellent and attached to a surface of the suction member adjacent to the first interference prevention portion; and a second water repellent surface provided with the water repellent member which is treated with the water repellent and attached to a surface of the base plate adjacent to the second interference prevention portion.

12. The refrigerator according to claim 11, wherein the first water repellent surface is provided so that the water repellent member is divided into a plurality of water repellent members and attached to the first water repellent surface.

13. The refrigerator according to claim 10, wherein the water repellent surface includes:

a first water repellent surface provided such that a water repellent material is coated on a surface of the suction member adjacent to the first interference prevention portion; and a second water repellent surface provided such that the water repellent material is coated on a surface of the base plate adjacent to the second interference prevention portion.

14. A blower comprising:

a suction member having an air suction hole; and a fan configured to transfer air through the air suction hole and having an interference prevention portion provided on an outside end of the fan and configured to prevent an interference of the fan with the suction member, wherein the suction member further includes a water repellent surface provided adjacent to the interference prevention portion of the fan, to reduce an amount of ice formed on the water repellent surface, and the water repellent surface is provided with a water repellent member which is treated with a water repellent and attached to an edge of the cold air suction hole adjacent to the interference prevention portion.

15. The blower according to claim 14, wherein:

the fan further includes a motor, a hub connected to the motor by a rotary shaft, and a plurality of blades provided to extend in a radial direction from the hub; and the interference prevention portion is provided on an end portion furthest from the hub of each of the plurality of blades.

16. The blower according to claim 14, wherein:

the fan further includes a motor, a fan connected to the motor by a rotary shaft, a base plate, and a base plate on which the motor is mounted; and the interference prevention includes a first interference prevention portion provided to be adjacent to the suction member and a second interference prevention portion provided to be adjacent to the base plate.

17. The blower according to claim 16, wherein the water repellent surface includes:

a first water repellent surface provided on a surface of the suction member adjacent to the first interference prevention portion; and a second water repellent surface provided on a surface of the base plate adjacent to the second interference prevention.

* * * * *